US005161840A

United States Patent [19]

Vaught

[11] Patent Number: 5,161,840

[45] Date of Patent: Nov. 10, 1992

[54] DOOR HANDLE WITH CAMMING LATCH

[75] Inventor: Michael O. Vaught, London, Ky.

[73] Assignee: Westinghouse Electric Corp., Pittsburgh, Pa.

[21] Appl. No.: 817,705

[22] Filed: Jan. 7, 1992

[51] Int. Cl.[5] ..... E05C 5/02

[52] U.S. Cl. ..... 292/241; 292/61

[58] Field of Search ..... 292/205, 241, 58, 59, 292/61, 213, 251, DIG. 72, 240

[56] References Cited

U.S. PATENT DOCUMENTS

| | | | |
|---|---|---|---|
| 739,640 | 9/1903 | Beehler | 292/58 |
| 878,167 | 2/1908 | Webster | 310/89 |
| 2,787,487 | 1/1955 | Baker, Jr. | 292/4 |
| 3,662,198 | 5/1972 | Adams | 310/89 |
| 4,688,835 | 8/1987 | Wu | 292/59 |
| 4,707,628 | 11/1987 | Obley | 310/89 |

*Primary Examiner*—Richard E. Moore

*Attorney, Agent, or Firm*—Aileen C. Addessi

[57] ABSTRACT

A door handle for breaking a vacuum seal and opening a door in a single operation includes a handle and a latch cam, attached to the door, and a pin, attached to a frame of the door. The pin is engageable with a slot positioned on the latch cam. The slot extends circumferentially around at least a portion of the diameter of the latch cam. Due to the configuration of the slot, as the pin travels within the slot to a closed end of the slot, the pin progresses from a position farther from the door to a position closer to the door, causing the pin to exert pressure on a second surface of the slot, which pulls the door toward the frame to close the door. As the pin travels within the slot away from the closed end of the slot, the pin progresses from a position closer to the door to a position farther from the door, causing a first surface of the slot to exert pressure on the pin, which breaks the vacuum seal and unlatches the door to open the door of a housing.

17 Claims, 2 Drawing Sheets

DOOR HANDLE WITH CAMMING LATCH

BACKGROUND OF THE INVENTION

This invention relates to a handle for opening and closing a door and, more particularly, to a door handle capable of breaking a vacuum seal and opening a door in a single step, such as for the collector/exciter housing of an electrical generator.

An enclosed housing may have a negative pressure within the housing as compared to atmospheric pressure, requiring a sufficient force to break the vacuum seal to open a door of the housing. As an example, when a generator is in operation, the pressure inside of the housing around the collector and the excitor is less than atmospheric pressure due to the pressure drops associated with the ventilation system. During service, before an operator enters the collector and excitor housing, atmospheric pressure must be reestablished.

Vacuum break assemblies have been used in combination with door handles to open the doors. These arrangements require first opening a sealed vacuum break panel and then, lifting a handle to unlatch the door.

A housing door handle that both breaks the vacuum seal and unlatches the door have been used. In operation, as the handle is rotated, a latch cam disengages from a catch, and a cam assembly pushes against a pin to force the door open, while breaking the vacuum seal. However, this door handle requires a precise clearance between the pin and the latch, requiring each handle to be custom fit, resulting in higher costs.

Therefore, what is needed is a door handle which breaks the vacuum seal and opens the door in a single step and which may be easily adjusted to fit a range of pin positions for efficient installation of the door handle.

SUMMARY OF THE INVENTION

An apparatus for opening and closing a door includes a handle attached to the door and a latch cam, which is attached to the handle. The latch cam has a slot, which circumferentially extends from a first end of the latch cam towards a second end of the latch cam. A pin attached to a frame of the door engages the slot and travels within the slot as the handle is rotated.

The slot includes a notch for capturing the pin to latch the pin and the handle together. The slot has a first surface which circumferentially extends from a first open section to a second open section for applying pressure against the pin to break a vacuum seal and to open the door as the handle is rotated. The slot has a second surface which circumferentially extends from the second open section to the notch for enabling the pin to apply pressure against the second surface to force the door against the frame as the handle is rotated to close the door.

The door handle may include a spring attached to the handle for adjusting the position of the slot with respect to the position of the pin, a locking ring positioned adjacent to the spring for engagement with a groove positioned on the handle for locking the handle, the spring, and the latch cam together, and at least one washer positioned between the latch cam and the door for adjusting the position of the slot with respect to the pin.

BRIEF DESCRIPTION OF THE DRAWINGS

While the specification concludes with claims particularly pointing out and distinctly claiming the subject matter of the invention, it is believed the invention will be better understood from the following description, taken in conjunction with the accompanying drawings, wherein:

DESCRIPTION OF THE PREFERRED EMBODIMENT

The invention described herein provides an apparatus for breaking a vacuum seal and unlatching a door in one operation by means of a single part.

Figure 1:
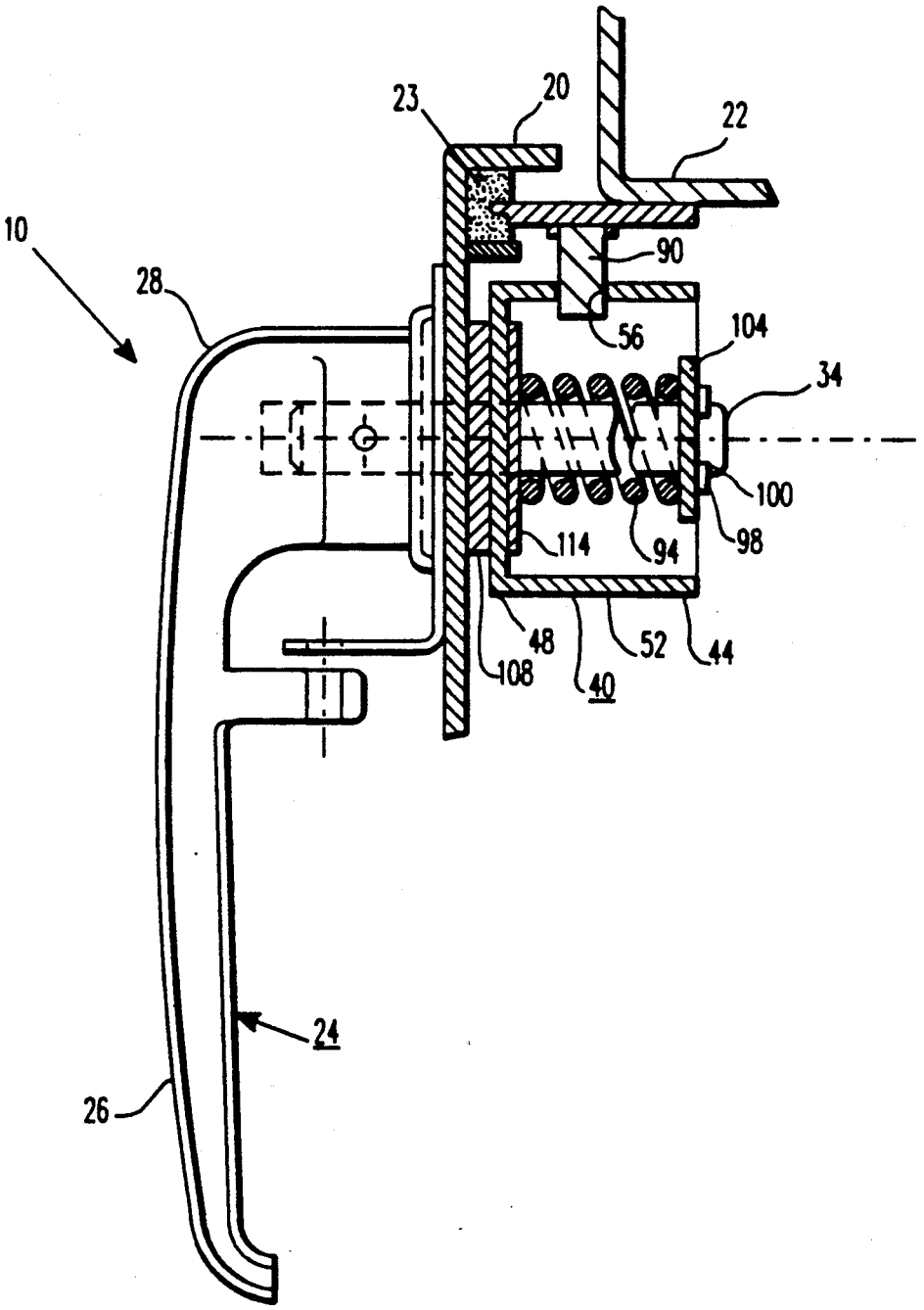
FIG. 1 is a sectional view of a door handle installed on a door.

Referring to FIG. 1, a door handle 10 is shown attached to a door 20. The door 20 covers an aperture in the frame 22 of the door 20. A seal 23 may be attached to the door 20 or to the frame 22 for sealing the housing when the door 20 contacts the door frame 22.

The door handle 10 includes a handle 24 having a first end portion 26 and a second end portion 28. The first end portion 26 of the handle 24 is configured to enable an operator to grasp the handle for manual rotation of the handle to open or close the door 20. The second end portion 28 of the handle 24 is attached to a handle shank 34.

As illustrated in FIG. 1, the second end portion 28 of the handle 24 is abutted against the door 20 with the handle shank 34 extending through an aperture in the door 20.

Figure 2:
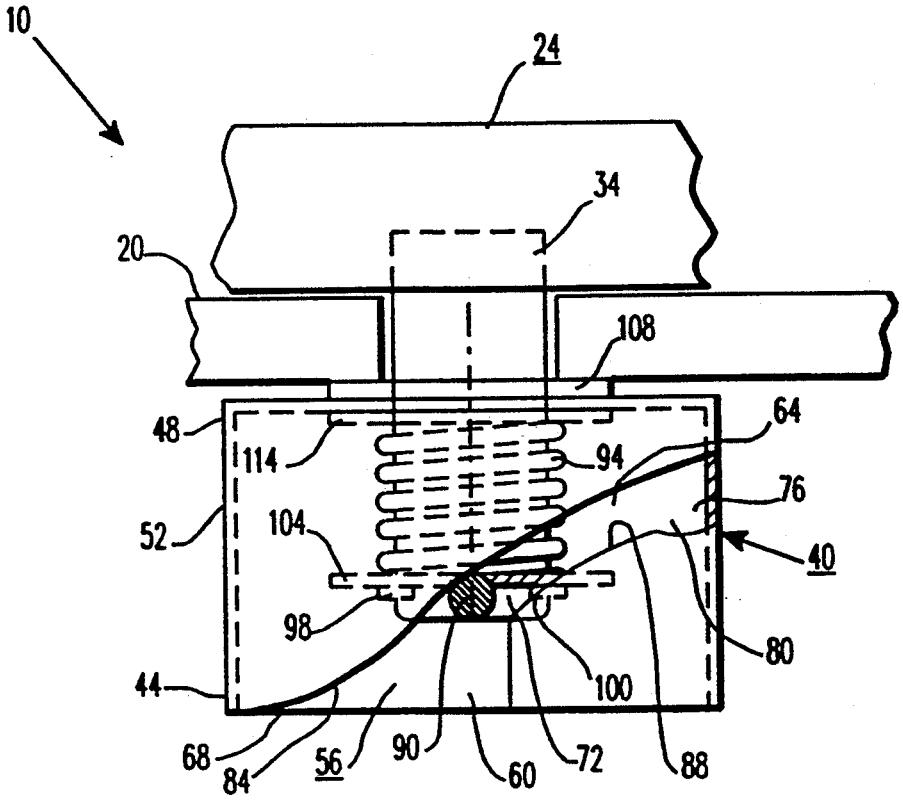
FIG. 2 is a partial sectional view of a pin engaging a circumferentially extending slot positioned in a latch cam of the door handle.

Referring to FIGS. 1 and 2, the door handle 10 also includes a latch cam 40, which may be fabricated from a length of standard schedule 80 pipe. The latch cam 40 has a first end 44, a second end 48, and a wall 52 therebetween. The second end 48 is a closed end having an aperture for receiving the handle shank 34 of the handle 24. The first end 44 may be a closed end or an open end.

When the door handle 10 is assembled, the handle 24 is positioned on one side of the door 20 and the latch cam 40 is positioned on an opposite side of the door 20. The second end 48 of the latch cam 40 is positioned adjacent to the door 20.

The latch cam 40 has a slot 56, positioned in the wall 52 of the latch cam 40, which extends circumferentially around at least a portion of the diameter of the latch cam 40 from the first end 44 towards the second end 48. The slot 56 has a first end portion 60 and a second end portion 64. The first end portion 60 has a first open section 68 positioned at the first end 44 of the latch cam 40 and a second open section 72 positioned adjacent to the second end portion 64. The second end portion 64 has a closed end 76, which includes a notch 80. A first surface 84 extends from the first open section 68 of the first end portion 60 to the closed end 76 of the second end portion 64 of the latch cam 40. A second surface 88 extends from the second open section 72 of the first end portion 60 to the closed end 76 of the second end portion 64 of the latch cam 40.

A pin 90 is attached, such as by welding, to the frame 22 of the door 20. The pin 90 has a shape corresponding to the slot 56 of the latch cam 40 so that the pin 90 may engage the slot 56 and may travel within the slot 56. As an example, the pin 90 may be cylindrical or may have the shape of a block.

Still referring to FIGS. 1 and 2, the door handle 10 includes a spring 94, which attaches the latch cam 40 to the handle 24. As an example, the spring 94 may be a disc spring. An adjustment of the spring 94 adjusts the position of the latch cam 40 with respect to the position of the pin 90 for enabling the door handle 10 to be utilized for a range of pin 90 positions. Utilization of the spring 94 also reduces the time required for installation of the door handle 10 onto the door 20. The spring 94 is positioned within the latch cam 40.

A locking ring 98 is positioned adjacent the spring 94 at the first end 44 of the latch cam 40. The handle shank 34 has a groove 100 corresponding to the size and shape of the locking ring 98 for engagement of the locking ring 98 into the groove 100 to hold together the door handle 10.

At least one washer 104 is positioned between the locking ring 98 and the spring 94 for providing a surface for the locking ring 98 to hold the coils of the spring 94.

A washer 108 is positioned between the door 20 and the latch cam 40 to alter the position of the slot 56 with respect to the position of the pin 90. A single washer or a plurality of washers may be positioned between the door 20 and the latch cam 40 for varying the range of fit of the door handle 10 to the pin 90. Also, the number of washers may be varied to provide a gap between the door 20 and the frame 22 when the pin 90 engages the latch cam 40.

At least one washer 114 may also be positioned between the spring 94 and the latch cam 40 for providing a desired spring pre-load.

OPERATION

Referring again to FIGS. 1 and 2, the door 20 is closed so that the door 20 covers the aperture in the frame 22. The pin 90 engages the slot 56 in the latch cam 40 as the door 20 is closed. The pin 90 enters the slot 56 through the first open section 68 and engages the first surface 84 of the slot 56. Preferably, the pin 90 engages the slot 56 at the second open section 72 for providing a sufficient length of the first surface 84 for contacting the pin 90 and a sufficient length of the second surface 88 for contacting, the pin 90.

Turning the handle 24 rotates the latch cam 40. As the latch cam 40 is rotated to close the door 20, the second surface 88 of the slot 56 contacts the pin 90, capturing the pin 90 within the slot 56. As the handle 24 continues to turn, the pin 90 travels along the second end portion 64 of the slot 56.

Because of the shape of the slot 56, as the pin 90 travels within the slot 56 towards the closed end 76 of the slot 56, the pin moves from a point farther from the door 20, i.e. the first end 44 of the latch cam 40, and progresses toward a point closer to the door 20, i.e. the second end 48 of the latch cam 40. As the handle 24 is turned, the force exerted by the pin 90 onto the second surface 88 increases as the pin 90 progresses toward the closed end 76 of the slot 56, pulling the door 20 against the frame 22 to seal the housing. The pin 90 is latched in the latch cam 40 when the pin 90 engages the notch 80 of the slot 56.

A vacuum may be created within the housing, such as by the operation of ventilation equipment within a collector housing of a generator.

To open the door 20 of the housing, the handle 24 is rotated in a direction opposite to the direction that the handle 24 is rotated for closing the door 20. Turning the handle 24 of the door handle 10 rotates the latch cam 40, releasing the pin 90 from the notch 80 of the slot 56. As the latch cam 40 continues to rotate, the pin 90 travels within the slot 56 from the second end 48 of the latch cam 40 towards the first end 44 of the latch cam 40.

At a particular point of travel of the pin 90 within the slot 56, such as at the second end section 72, the pin 90 ceases to exert pressure on the second surface 88 of the slot 56 and the first surface 84 of the slot 56 begins to exert pressure on the pin 90. Due to the shape of the slot 56, as the handle 24 continues to turn, the force exerted by the first surface 84 onto the pin 90 increases as the pin 90 progresses toward the first end 44 of the slot 56. The force of the first surface 84 against the pin 90 breaks the vacuum seal and forces the door 20 open. Also, the pressure from the air rushing in around an edge of the door 20 helps to push the door open.

Therefore, the invention provides a door handle for breaking a vacuum seal and unlatching a door in a single operation for a range of pin positions.

What is claimed is:

1. Apparatus for opening and closing a door, comprising:

a handle attached to the door;

a latch cam attached to the handle and having a slot, the slot circumferentially extending from a first end of the latch cam towards a second end of the latch cam;

a pin attached to a frame of the door for engaging the slot and traveling within the slot as the handle is rotated; and a spring attached to the handle for adjusting the position of the slot with respect to the position of the pin.

2. The apparatus according to claim 1, wherein the slot further comprises a notch for capturing the pin to latch the pin and the handle together.

3. The apparatus according to claim 1, wherein the slot has a first end portion and a second end portion, the first end portion having a first open section for receiving the pin and a second open section for directing the pin into the second end portion of the slot.

4. The apparatus according to claim 3, wherein the first end portion of the slot has a first surface which circumferentially extends from the first open section to the second open section for applying pressure against the pin to break a pressure seal and to open the door as the handle is rotated.

5. The apparatus according to claim 3, wherein the second end portion of the slot has a second surface extending from the second open section of the first end portion to the closed end of the second end portion of the slot for enabling the pin to apply pressure against the second surface to force the door against the frame as the handle is rotated.

6. The apparatus according to claim 1, further comprising a locking ring positioned adjacent to the spring for locking the handle, the spring, and the latch

7. The apparatus according to claim 6, wherein the handle further comprises a handle shank having a groove for, engagement of the groove with the locking ring.

8. The apparatus according to claim 1, further comprising at least one washer positioned between the spring and the latch cam for adjusting the pre-load of the spring.

9. The apparatus according to claim 1, further comprising at least one washer positioned between the latch cam and the door for positioning the slot with respect to the pin.

10. Apparatus for opening and closing a door, comprising:

a handle attached to the door;

a latch cam having a fit end and a second end, the second end attached to the handle;

the latch cam having a slot with a fist open section positioned at the first end of the latch cam, a fist surface, a second surface, and a closed end, the slot circumferentially extending from the first and of the latch cam toward the second end of the latch cam;

a pin, attached to a frame of the door, mateably engaging to the slot for travelling between the first open section and the closed end of the slot, the pin exerting pressure on the second surface of the slot as the pin travels toward the second end or the latch cam for pulling the door towards the frame as the handle is rotated and the list surface to the slot exerting pressure on the pin as the pin travels toward the first end of the latch cam for breaking a vacuum seal and unlatching the door as the handle is rotated; and a spring attached to the handle for adjusting the position of the slot with respect to the position of the pin.

11. The apparatus according to claim 10, wherein the slot further comprises a notch positioned at the closed end for capturing the pin to latch the pin and the handle together.

12. The apparatus according to claim 10, further comprising at least one washer positioned between the latch cam and the door for positioning the slot with respect to the pin.

13. Apparatus for opening and closing a door, comprising:

a handle positioned on a first side of the door;

a latch cam positioned on an opposite side of the door having a first end and a second end, the second end attached to the handle;

the latch cam having a slot, the slot circumferentially extending from the first end of the latch cam towards the second end of the latch cam;

a pin attached to a frame of the door for engaging the slot and traveling within the slot as the handle is rotated; and a spring attached to the handle and positioned within the latch cam for adjusting the position of the slot with respect to the position of the pin.

14. The apparatus according to claim 13, further comprising at least one washer positioned between the latch cam and the door for positioning the slot with respect to the pin.

15. The apparatus according to claim 13, wherein the slot further comprises a notch for capturing the pin to latch the pin and the handle together.

16. The apparatus according to claim 13, wherein the slot has a first surface which circumferentially extends from the first end of the latch cam to a closed end of the slot for applying pressure against the pin to break a vacuum seal and to open the door as the handle is rotated.

17. The apparatus according to claim 13, wherein the slot has a second surface extending circumferentially around at least a portion of the latch cam for the pin to apply pressure against the second surface to pull the door against the frame as the handle is rotated.

* * * * *